US006739710B2

(12) United States Patent
Lin et al.

(10) Patent No.: US 6,739,710 B2
(45) Date of Patent: May 25, 2004

(54) PRESSURE-REGULATING AIRBAG FOR EMBEDDING-TYPE INK CARTRIDGE AND THE METHOD FOR ASSEMBLING IT

(75) Inventors: Chien-Ming Lin, Taipei (TW); Chuang-Hsien Chiu, Hsinchu (TW)

(73) Assignee: NanoDynamics Inc., Hsinchu Hsien (TW)

( * ) Notice: Subject to any disclaimer, the term of this patent is extended or adjusted under 35 U.S.C. 154(b) by 0 days.

(21) Appl. No.: 10/327,124

(22) Filed: Dec. 24, 2002

(65) Prior Publication Data

US 2003/0122908 A1 Jul. 3, 2003

(30) Foreign Application Priority Data

Dec. 28, 2001 (TW) ..... 90132896 A

(51) Int. Cl.[7] ..... B41J 2/175
(52) U.S. Cl. ..... 347/86
(58) Field of Search ..... 347/84, 85, 86, 347/87

(56) References Cited

U.S. PATENT DOCUMENTS 5,409,134 A * 4/1995 Cowger et al. ..... 222/1
5,923,353 A * 7/1999 Boyd et al. ..... 347/85
5,988,803 A * 11/1999 Komplin et al. ..... 347/86
6,003,966 A * 12/1999 Ahn ..... 347/7
6,203,146 B1 * 3/2001 Pawlowksi et al. ..... 347/85
6,213,598 B1 * 4/2001 Hou et al. ..... 347/86
6,293,666 B1 * 9/2001 Mou et al. ..... 347/87

* cited by examiner

*Primary Examiner*—Anh T. N. Vo
(74) *Attorney, Agent, or Firm*—Birch, Stewart, Kolasch & Birch, LLP

(57) ABSTRACT

This specification discloses a negative pressure-regulating airbag for an embedding-type ink cartridge and its assembly method. In addition to a bag with a variable volume, the negative pressure-regulating airbag has a buckle ring, a plate, and a elastic element. The buckle ring is closely connected to the bag. A vent hole is formed in the middle of the buckle ring, allowing air to enter or escape the airbag when the ambient pressure changes. The buckle ring has a protruding part on the surface of the bag so as to be embedded into a preserved hole on an ink cartridge by pressing during the assembly. This forms a quick and tight connection between the airbag and the ink cartridge. One end of the elastic element is connected to the ink cartridge and the other end to the plate so that the plate imposes a force to depress the airbag. This keeps a negative pressure inside the cartridge to prevent ink leakage from the cartridge during transportation or use.

11 Claims, 6 Drawing Sheets

PRESSURE-REGULATING AIRBAG FOR EMBEDDING-TYPE INK CARTRIDGE AND THE METHOD FOR ASSEMBLING IT

BACKGROUND OF THE INVENTION

1. Field of Invention

The invention relates to a pressure-regulating airbag for ink cartridges and, in particular, to an airbag that is embedded in an ink cartridge and the assembly method therefor.

2. Related Art

The ink cartridge is an essential element for any inkjet pen. If there is no pressure-regulating device inside the cartridge, ink may leak out when the ambient pressure becomes low, for example, during transportation by air. This will result in unacceptable inkjet cartridge products. Moreover, unexpected temperature rise in the storage place is likely to increase the pressure inside the cartridge that may cause ink leakage too.

The importance of the pressure-regulating design of the ink cartridge is further seen in the continuous operation of an inkjet mechanism. As the ink is consumed, the ink volume becomes smaller, resulting in an increasing negative pressure. If the pressure is not appropriately tuned, the negative pressure may diminish or cancel with the ink ejection force from the inkjet chip, losing the ink droplet ejection precision. Eventually, the inkjet printer performance will be seriously affected. What is worse is that the internal negative pressure disallows the inkjet chip to eject ink before the ink is depleted.

There are already many patents or products with an ink cartridge negative pressure reduction mechanism. For example, a classic example is the U.S. Pat. No. 5,409,134. It proposed a design that used a thin plate spring to support the airbag. After then, various ideas were disclosed in accord with the pros and cons of the patent. However, most of the known designs put emphasis upon the variations and modifications in the pressure-regulating mechanisms, but the problem of how to increase the efficiency of assembling the inkjet cartridge and pressure-regulating element is never addressed.

SUMMARY OF THE INVENTION

An objective of the invention is to provide a negative pressure-regulating airbag that is embedded into an ink cartridge by pressing and the method for assembling it, so that the assembly of the airbag and the ink cartridge can be quickly and conveniently achieved.

In addition to a bag with a variable volume, the disclosed negative pressure-regulating airbag has a buckle ring, a plate, and an elastic element. The buckle ring is closely connected to the bag. A vent hole is formed in the middle of the buckle ring, allowing air to enter or escape the airbag when the ambient pressure changes. The buckle ring has a protruding part on the surface of the bag so as to be embedded into a preserved little hole on an ink cartridge by pressing during the assembly. This forms a quick and tight connection between the airbag and the ink cartridge. One end of the elastic element is connected to the ink cartridge and the other end to the plate so that the plate imposes a force to depress the airbag. This keeps the negative pressure inside the cartridge within a desired range to prevent ink leakage from the cartridge due to the ambient pressure change during transportation or use.

BRIEF DESCRIPTION OF THE DRAWINGS

The invention will become more fully understood from the detailed description given hereinbelow illustration only, and thus are not limitative of the present invention, and wherein.

DETAILED DESCRIPTION OF THE INVENTION

First Embodiment

Figure 1:
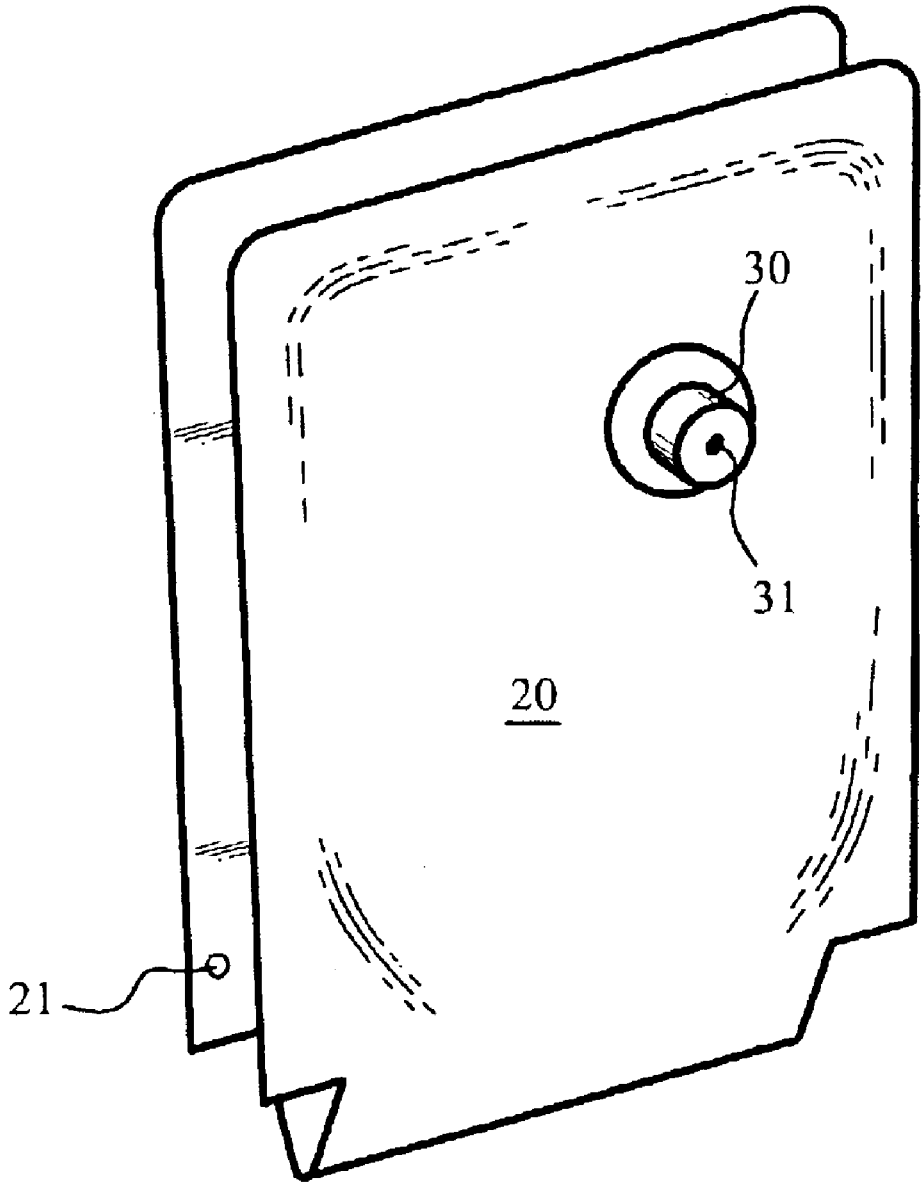
FIG. 1 is a schematic view of the disclosed airbag according to a first embodiment of the invention.
Figure 2:
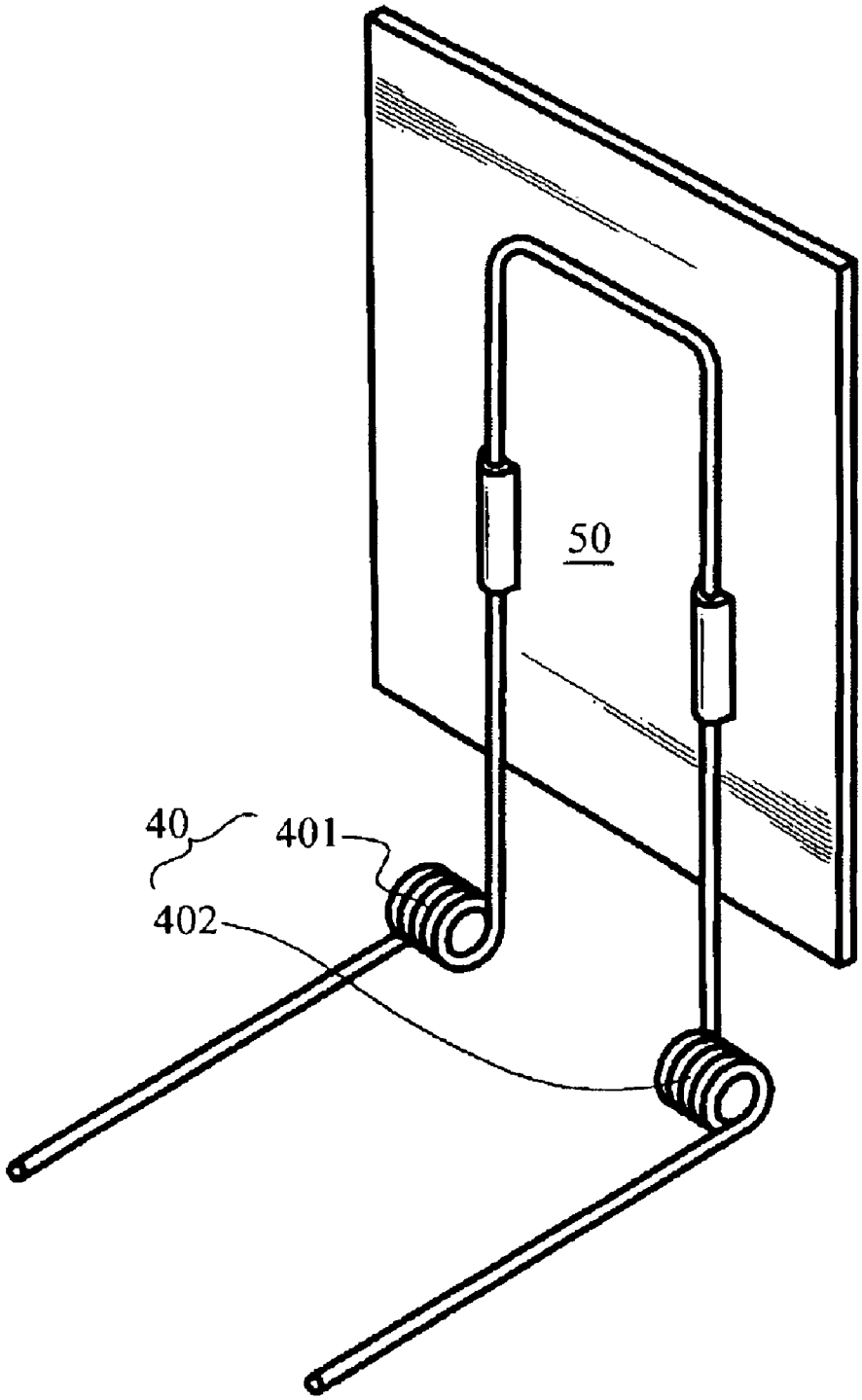
FIG. 2 is a schematic view showing the relation among the spring, plate and ink cartridge in FIG. 1.

As shown in FIG. 1, the disclosed negative pressure-regulating airbag 20 has a bag with a variable volume, a buckle ring 30, a plate 50, and an elastic element 40 (see FIG. 2). The buckle ring 30 is tightly sealed onto the bag. A vent hole 31 is formed in the middle of the buckle ring 30 for air to enter or escape the airbag 20 when the ambient pressure changes. The buckle ring 30 has a protruding part 32 so as to be embedded into a preserved little hole 11 on an ink cartridge 10 by pressing during assembly. Therefore, the connection between the bag and the ink cartridge 10 is quick and air-proof.

With reference to FIG. 2, the elastic element 40 comprises two torsion spring 401, 402. One end of each torsion spring 401, 402 is connected with each other and to the plate 50. The other end of each torsion spring 401, 402 is connected to the ink cartridge. The elastic element 40 imposes an evenly distributed force on the airbag 20 via the plate 50. The pressure inside the ink cartridge 10 is thus kept within a desired range because the airbag 20 tends to shrink. This can avoid ink leakage during transportation or storage or the ambient air pressure suddenly changes during use.

Figure 6:
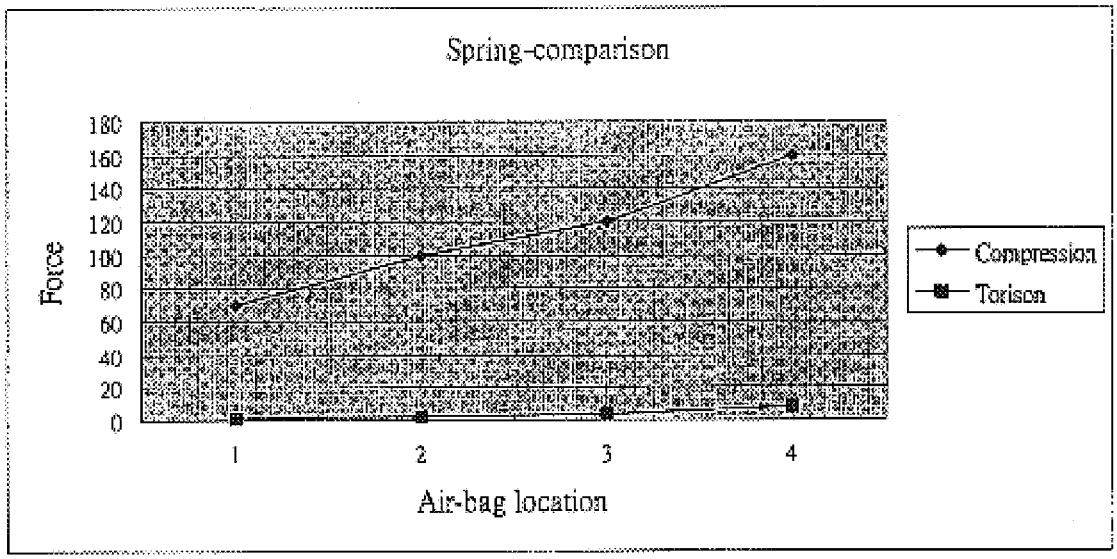
FIG. 6 is a diagram of the force to the location for compression springs and torsion springs.

With reference to FIG. 6, the force of the compression spring is increasing with the change of the air-bag location. This will increase the balancing pressure of the air-bag to let the controlling difficult and unstable. But the force of the torsion spring is near equal between operation ranges, though the change of the air-bag location. So it improves the stability of the pressure controlling.

Other Variations of the Embodiment

Aside from the above-mentioned embodiment, a person skilled in the part can further make various changes or modifications. For example, an element such as a wavy plate (not shown) can be disposed at the bending part of the air bag 20 to avoid opposite sides of the bag from sticking together. This can ensure that the air flows through the bending part without resistance.

Figure 3:
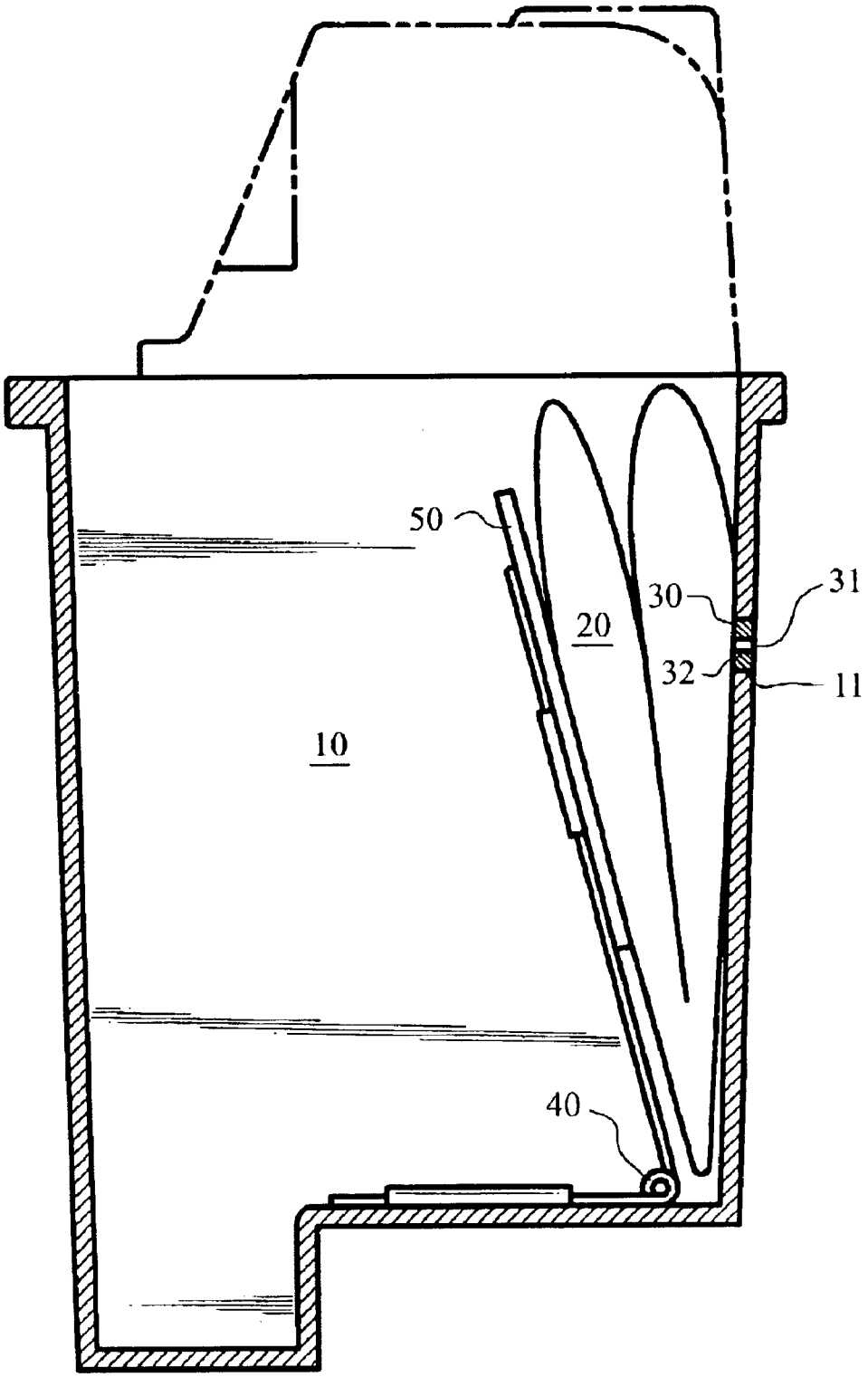
FIG. 3 is a schematic view of pressure adjustment in FIG. 1.
Figure 4:
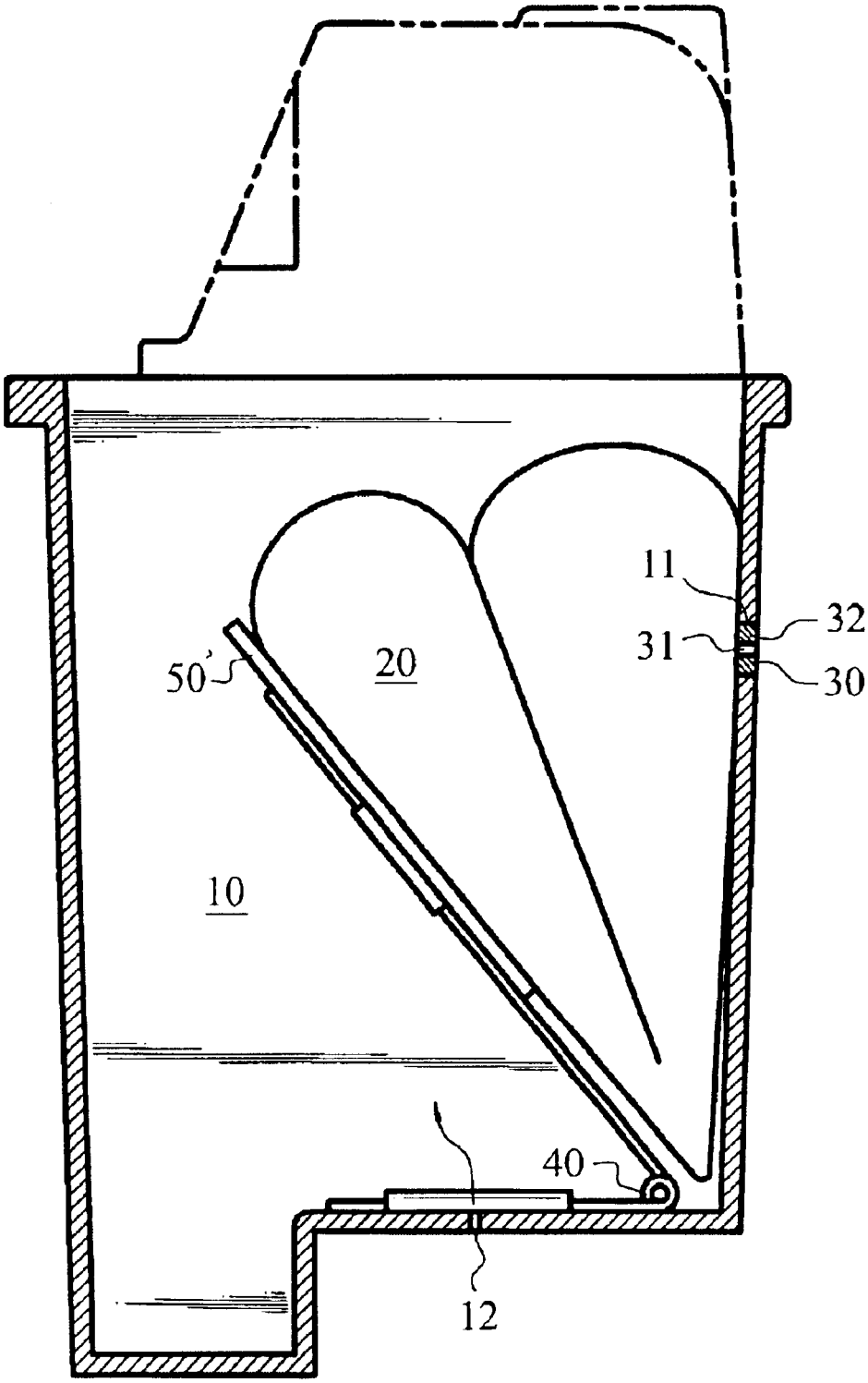
FIG. 4 is a schematic view of replenishing air in FIG. 1.
Figure 5:
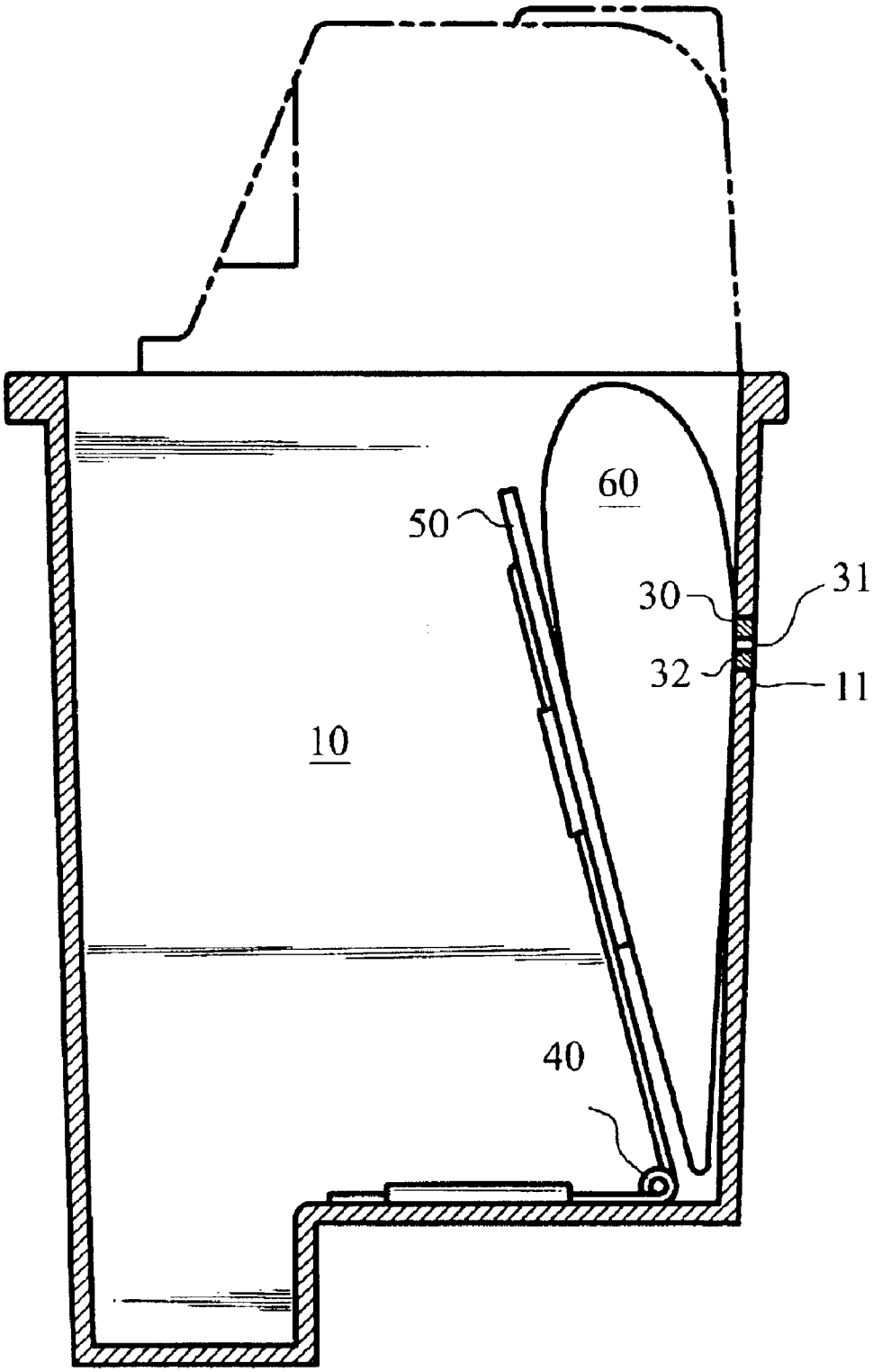
FIG. 5 is another embodiment of the invention.

Moreover, as shown in FIG. 5, the airbag 20 is changed from the folding type in FIGS. 1 through 4 to a non-folding one 60. This also achieves the objective of the invention.

Although the buckle ring 30 is embedded into a preserved little hole 11 on the ink cartridge 10 through its protruding part 32, it is more desirable to form a one-way tilted texture, anti-skidding teeth, or equivalent means on the surface of the protruding part 32 so that it is completely fixed once being inserted into the little hole 11. Based upon the same idea, a back hook or a stopper can be formed at the end of the protruding part 32. Examples are an O-ring or another buckle ring that holds the protruding part 32.

The above-mentioned variations of the disclosed embodiment are for illustrative purposes, and should not be construed as limitations of the scope of the invention. Any person skilled in the art can make other equivalent changes to the quality, appearance, and according to the costs.

Embodiment of the Assembly Procedure

The assembly method for the negative pressure adjusting airbag 20, 60 is implemented through the following steps:

1. Connect the bag of the negative pressure adjusting airbag 20, 60 with the buckle ring 30. With reference to FIG. 1, the buckle ring 30 can be made of the same material as the bag surface (e.g. polyethylene) or some other material that can be easily assembled and produced by ejection. Afterwards, the buckle ring 30 is fixed onto the bag by surface mounting, thermal bonding, or bonding through vibration welding means (e.g. ultrasonic or high-frequency waves).
2. Connect the elastic element 40 with the plate 50. With reference to FIG. 2, the plate 50 and the one end of the elastic element 40 can be connected by plugging, thermal welding or other equivalent means.
3. Connect the elastic element 40 with the ink cartridge 10. Pull the elastic element 40 and the plate 50 away from the ink cartridge 10.
4. Insert the bag. With reference to FIG. 3, the airbag is mounted by pressing the buckle ring 30 on the bag so that the protruding part 32 is embedded into the little hole 11 preserved on the ink cartridge 10.
5. Release the elastic element 40 and the plate 50. The plate 50 depresses the bag so that the airbag tends to shrink inside the cartridge.

The steps 1 and 2 can be processed at the same time on different assembly lines. Steps 3 and 4 can be interchanged in order without departing from the spirit of the invention.

With simultaneous reference to FIGS. 4 and 5, the ink consumption during normal inkjet printing processes increases the negative pressure inside the ink cartridge so that the atmospheric pressure becomes larger. Therefore, the ambient air goes into the airbag 20, 60 through the vent hole 31. This increases the volume of the airbag 20, 60 to balance the negative pressure, keeping the negative pressure within a normal range. To avoid an extreme operating environment, the airbag 20, 60 or the ink cartridge 10 can be formed with an additional bubble generator 12, 21 so that when the pressure difference becomes too large, the air can enter through the bubble generator 12, 21. Since the principle and technique of the bubble generator 12, 21 are well-known, we do not repeat them herein.

Improvement Results

The invention provides a negative pressure adjusting airbag that can be embedded in an ink cartridge and the assembly method therefor. Steps 1 and 2 mentioned above can be performed separately and simultaneously at different places or assembly lines. This makes the production arrangement more flexible. The connection of the airbag and the ink cartridge can be easily achieved by pressing. The invention is very different from the conventional ink cartridge assembly procedure.

What is claimed is:

1. An embedding-type negative pressure-regulating airbag for an ink cartridge comprising:

an airbag being a bag with a variable volume;

a buckle ring tightly connected to the airbag and has a protruding part that is to be embedded in a little hole preserved on the ink cartridge, the center of the buckle ring having a vent hole for air to enter or escape;

an elastic element, including two torsion spring, one end of each torsion spring is connected with each other and the other end of each torsion spring is connected to the ink cartridge; and a plate connected with said end of the torsion spring for transferring a spring force to depress the airbag.

2. The embedding-type negative pressure-regulating airbag of claim 1, wherein the airbag has a bubble generator for air to enter from the airbag to the ink cartridge.

3. The embedding-type negative pressure-regulating airbag of claim 1, wherein the ink cartridge has a bubble generator for air to enter from its outside into its inside.

4. An assembly method for an embedding-type negative pressure-regulating airbag for an ink cartridge comprising the steps of:

preparing a buckle with a protruding part and a vent hole for connection with a bag with a variable volume;

preparing a plate connecting to one end of an elastic element;

preparing an ink cartridge, which is preserved with a little hole and connected with the other end of the elastic element, and pulling the elastic element and the plate away from the ink cartridge;

inserting the bag and pressing the buckle ring so that the protruding part is embedded in the preserved little hole, thereby connecting the bag with the ink cartridge; and releasing the elastic element and the plate for the elastic element to depress the bag through the plate, so that the volume of the bag tends to shrink.

5. The assembly method of claim 4, wherein the buckle ring is made of a material selected from the group consisting of the same material as the bag surface and materials that are easy to assemble and produced by ejection.

6. The assembly method of claim 4, wherein the buckle is connected to the bag by surface mounting.

7. The assembly method of claim 4, wherein the buckle ring is connected to the bag by a means selected from the group consisting of thermal bonding and vibration welding.

8. An assembly method for an embedding-type negative pressure-regulating airbag for an ink cartridge comprising the steps of:

preparing a buckle ring with a protruding part and a vent hole for connection with a bag with a variable volume;

preparing an ink cartridge preserved with a little hole and inserting the bag, pressing the buckle ring so that the protruding part is embedded into the little hole, thereby connecting the bag with the ink cartridge;

preparing a plate connecting to one end of an elastic element; and connecting the other end of the elastic element with the ink cartridge so that the elastic element depresses the bag through the plate, the volume of the bag tending to shrink.

9. The assembly method of claim 8, wherein the buckle ring is made of a material selected from the group consisting of the same material as the bag surface and materials that are easy to assemble and produced by ejection.

10. The assembly method of claim 8, wherein the buckle ring is connected to the bag by surface mounting.

11. The assembly method of claim 8, wherein the buckle ring is connected to the bag by a means selected from the group consisting of thermal bonding and vibration welding.

* * * * *